United States Patent [19]

Cupper

[11] 4,244,831

[45] Jan. 13, 1981

[54] SILICONE-HYDROCARBON COMPOSITIONS

[75] Inventor: Robert A. Cupper, Ridgefield, Conn.

[73] Assignee: Union Carbide Corporation, New York, N.Y.

[21] Appl. No.: 674,649

[22] Filed: Apr. 7, 1976

[51] Int. Cl.[2] ..... C10M 3/46

[52] U.S. Cl. ..... 252/78.3

[58] Field of Search ..... 252/78, 49.6, 59, 73, 252/78.3

[56] References Cited

U.S. PATENT DOCUMENTS

| | | | |
|---|---|---|---|
| 2,398,187 | 4/1946 | McGregor et al. | 252/78.3 |
| 2,466,642 | 4/1949 | Larsen | 252/49.6 X |
| 2,624,749 | 1/1953 | Bunnell | 260/448.8 R |
| 2,909,549 | 10/1959 | Bailey | 260/448.8 R |
| 3,113,167 | 12/1963 | Saver | 252/59 X |
| 3,149,178 | 9/1964 | Hamilton et al. | 252/59 X |
| 3,280,031 | 10/1966 | Brennan et al. | 252/78 X |
| 3,317,428 | 5/1967 | Pater | 252/75 |
| 3,780,128 | 12/1973 | Shubkin | 252/59 X |
| 3,821,114 | 6/1974 | Brown | 252/78 |
| 3,833,505 | 9/1974 | Brown | 252/78 |
| 3,873,464 | 3/1975 | Bieber | 252/78 |

FOREIGN PATENT DOCUMENTS

| | | |
|---|---|---|
| 507713 | 11/1954 | Canada . |
| 2528397 | 1/1976 | Fed. Rep. of Germany . |

*Primary Examiner*—Harris A. Pitlick

*Attorney, Agent, or Firm*—Richard J. Gallagher

[57] ABSTRACT

Silicone-hydrocarbon compositions of matter having utility as lubricants and hydraulic fluids.

1 Claim, No Drawings

SILICONE-HYDROCARBON COMPOSITIONS

BACKGROUND OF THE INVENTION

This invention relates to compositions of matter useful as lubricants and hydraulic fluids and more particularly to silicon-hydrocarbon compositions of matter which may be used as lubricants and in various hydraulic systems where extremes of temperatures are encountered.

Hydraulic fluids having good viscosity-temperature viscosity-volatility and stability characteristics are very desirable. For instance, hydraulic fluids should in the broadest sense have viscosities high enough to satisfy the hydrodynamic requirements of the hydraulic pump and other elements of the hydraulic loop at the upper temperature extreme experienced and yet be low enough to flow freely at the lowest temperature expected. Attempts to attain such hydraulic fluids by the use of organosilicone materials have in general not proven particularly satisfactory. By way of illustration, silicone oils [i.e. materials having the formula $Me_3SiO(Me_2SiO)_xSiMe_3$] are not readily compatible with the elastomers ordinarily used in hydraulic systems. For instance, they tend to shrink SBR rubber gaskets often present in hydraulic systems which results in leakage of the silicone oil from the system. Silicone oils also have relatively poor lubricity for the metals conventionally used in hydraulic systems and hence relatively high wear is encountered when silicone oils are employed in such systems. Attempts to solve the disadvantages of such silicone oils by the addition thereto of conventional petroleum and other organic hydraulic fluids and/or the addition of conventional inhibitors such as anti-oxidants, rust and corrosion inhibitors, anti-wear agents, dispersants, and the like, have in general also not proven particularly successful since such silicone oils have exhibited very little ability if any to dissolve said conventional materials.

More recently liquid alkoxysiloxanes as disclosed in U.S. Application Ser. No. 579,600 filed May 21, 1975 have been proposed for use as a hydraulic fluid, as have mixtures of such types of alkoxysiloxanes along with a glycol ether phosphoric acid ester in U.S. Application Ser. No. 626,703 filed Oct. 29, 1975, now U.S. Pat. No. 3,974,080. In addition, hydraulic fluid compositions of an alkoxysiloxane and a hydrocarbon oil component selected from the group of naphthenic oils, branched chain aliphatic hydrocarbon oils and alkylated aromatic oils are disclosed in U.S. Application Ser. No. 656,387 filed Feb. 9, 1976, while compositions comprising a dimethylsiloxane oil and a hydrocarbon oil component selected from the group of naphthenic oils, branched chain aliphatic hydrocarbon oils and alkylated aromatic oils for use as lubricants and hydraulic fluids are disclosed in U.S. Application Ser. No. 656,386 filed Feb. 9, 1976, now U.S. Pat. No. 4,097,393. However, none of the above applications disclose the compositions of the instant invention.

It has now been discovered that silicone-hydrocarbon compositions of matter can be prepared which are useful as lubricants and hydraulic fluids and which have excellent viscosity-temperature, viscosity-volatility and thermal stability characteristics.

SUMMARY OF THE INVENTION

Therefore, it is an object of this invention to provide novel silicone-hydrocarbon compositions of matter which are useful as lubricants and hydraulic fluids. It is another object of this invention to provide a novel process that employs said silicone-hydrocarbon compositions of matter in a hydraulic system. Other objects and advantages of this invention will become readily apparent from the following description and appended claims.

More particularly this invention may be described as a composition of matter consisting essentially of (A) a silicone polymer selected from the class consisting of a dimethyl siloxane oil having a viscosity of from about 1 to about 200,000 centistokes at about 25° C. and consisting essentially of siloxy units of the formula $R_2SiO$ and end-blocking siloxy units of the formula $R_3SiO_{0.5}$ wherein R represents a methyl radical, and an alkoxysiloxane having the formula $$R'O[(CH_3)_2SiO]_nR'$$

wherein R' is a monovalent hydrocarbon group or a mixture of monovalent hydrocarbon groups, derived from an aliphatic alcohol or a mixture of aliphatic alcohols, respectively, having the formula R'OH by removal of the hydroxyl group, said alcohol or mixture of alcohols having a boiling point above about 78° C. at atmospheric pressure and wherein n is an integer having a value of about 5 to about 200; and (B) an olefin oligomer having a viscosity of from about 1 to about 30 centistokes at about 210° F., said oligomer containing at least one n-alkyl branch chain having at least four carbon atoms, and having been derived from the oligomerization of a normal alpha-olefin having from 6 to 40 carbon atoms; wherein the proportions of components of (A) to (B) range from about 55:95 percent by volume of (A) to about 45:5 percent by volume of (B) when the silicone polymer is a dimethyl siloxane oil and from about 50:95 percent by volume of (A) to about 50:5 percent by volume of (B) when the silicone polymeris an alkoxysiloxane; and wherein said proportions of (A) and (B) are selected such that said components (A) and (B) remain miscible with each other at about room temperature for at least 72 hours.

DESCRIPTION OF THE EMBODIMENTS

The dimethyl siloxane oils employed in this invention as well as methods for their preparation are well known and consist essentially of siloxy units of the formula $R_2SiO$ and end-blocking siloxy units of the formula $R_3SiO$ wherein R is a methyl radical. As employed herein such siloxane oils are essentially linear siloxane polymers having a viscosity in the range of about 1 to about 200,000 centistokes at about 25°0 C. preferably about 10 to about 100,000 centistokes at about 25° C., and most preferably about 10 to about 10,000 centistokes at about 25° C. These siloxane oils are also conventionally represented by the average formula $$R_3SiO(R_2SiO)_xSiR_3$$

wherein R is a methyl radical and x is an integer having a value that corresponds to the viscosity of the particular siloxane. For example, a trimethyl end-blocked dimethylsiloxane oil having a viscosity of 100 centistokes at 25° C. can be represented as having the average formula $$Me_3SiO(Me_2SiO)_{48}SiMe_3$$

wherein Me is a methyl radical.

It is to be understood, of course, that while the dimethyl siloxane oils used in this invention can be discrete chemical compounds they are usually mixtures of various discrete siloxane species, due at least in part, to the fact the starting materials used to produce the siloxane oils are themselves usually mixtures. Thus, it is obvious that the dimethyl siloxane oils employed herein need not be fractionated as by distillation but may be sparged (i.e. stripped of lites) or unsparged.

The alkoxy siloxanes employed in this invention as well as methods for their preparation are fully disclosed e.g. in U.S. Application Ser. No. 579,600 filed May 21, 1975 and U.S. Application Ser. No. 626,703 filed Oct. 29, 1975, the entire disclosures of said applications being incorporated herein by reference thereto. For instance the alkoxysiloxanes can be prepared by reacting a dimethylsiloxane hydrolyzate with a suitable alcohol or mixture of alcohols in the presence of a basic catalyst (e.g. potassium hydroxide) and aromatic solvent (e.g., xylene) at an elevated temperature (e.g., from 100° to 150° C.). The dimethylsiloxane hydrolyzate employed in producing the alkoxysiloxanes of this invention can be prepared by the hydrolysis of dimethyldichlorosilane in the presence of hydrochloric acid by conventional techniques. The hydrolyzate so produced consists of a mixture of cyclic dimethylsiloxanes and linear hydroxyl end-blocked dimethylsiloxanes. The alcohol reactants used in producing alkoxysiloxane for this invention are commercially available or can be prepared by a 2-step process. The first step is the oxo or hydroformylation reaction of olefins with carbon monoxide and hydrogen in the presence of a catalyst to produce an aldehyde intermediate. The second step is the hydrogenation of the intermediate to produce the alcohol. This 2-step process produces mixtures of alcohol (e.g., mixtures of isomeric isodecanols and mixtures of isomeric tridecanols). Alternativeiy, suitable alcohols can be produced by other processes that provide individual alcohols, e.g., ethanol, isopropanol, isobutanol, 3-methyl-1-butanol, 2-ethylhexanol, and the like. Preferably n has a value of 10 to 50 inclusive while the alcohols have from 2 to 18 carbon atoms and preferably from 10 to 14 carbon atoms.

The alkoxysiloxanes described above may be employed in the hydraulic fluids of this invention as such, i.e. stripped of all unreacted alcohols, or they may contain a minor amount of unreacted alcohols. For example, mixtures containing from 70 to 98 parts by weight of the alkoxysiloxane and from 30 to 2 parts by weight of unreacted alcohol per 100 parts by weight of the alkoxysiloxane-alcohol mixture may be employed. Generally it is preferred that such mixtures contain less than about 5 parts by weight of unreacted alcohol while the use of alkoxysiloxane stripped of all unreacted alcohols is most preferred.

Of course it is to be understood that mixtures of the above mentioned dimethylsiloxanes and alkoxysiloxanes can be employed, if desired.

The olefin oligomers which are employed in this invention are those which have been derived from the oligomerization of normal alpha-olefins having from 6 to 40 carbon atoms. Such olefin oligomers, also often referred to as polyalphaolefins, and/or methods for their preparation are well known in the art. For instance the olefin oligomers are highly branched hydrocarbon oils prepared by the controlled polymerization (oligomerization) of normal (straight chain) alpha-olefins using catalysts and reaction conditions known in the art, e.g. by free radical or ionic polymerization. The preparation of olefin oligomers may be further found described, e.g. in U.S. Pat. No. 2,937,129, British Pat. No. 873,064 and in A. Turner's doctorial dissertation entitled "The Polymerization of Octene-1 With Anhydrous Aluminum Chloride", University of Michigan, 1958. More specifically the olefin oligomers employed in this invention are those having a viscosity of from about 1 to 30 centistokes at about 210° F. (preferably about 2 to about 20 centistokes at about 210° F.) and which have been derived from the oligomerization of normal alpha-olefins having from 6 to 40 carbon atoms, preferably about 6 to 24 carbon atoms, and more preferably about 6 to 12 carbon atoms. It is, of course, to be understood that the term olefin oligomer as used herein includes both the unsaturated oligomers as well as the corresponding saturated (hydrogenated) oligomers. It is to be also understood that, if desired, in addition to employing a single type of olefin oligomer mixtures of two or more different olefin oligomers can be employed, just as it is obvious that a single alpha-olefin or mixture of different alpha-olefins can be used in the preparation of said olefin oligomers.

As pointed out above the olefin oligomers employed in this invention are highly branched hydrocarbon oils and each oligomer contains at least one normal alkyl (straight chain) branched chain having at least four carbon atoms, e.g. n-butyl, n-pentyl, etc., and are generally considered to have a spider or burr-like structure. For instance, oligomers derived from hexene-1 will contain at least one n-butyl branch chain, oligomers derived from heptene-1 will contain at least one n-pentyl branch chain and so forth up to oligomers containing at least one n-alkyl branch chain of 38 carbon atoms derived from a n-alpha-olefin of 40 carbon atoms. Thus, the olefin oligomers employed herein are totally distinct and different from commonly known isoparaffinic oils that contain only one to two carbon atoms in their branch chains.

While not wishing to be bound by any precise structural configuration for the olefin oligomers of this invention, for want of an illustration it is generally considered that trimers of specific n-alpha-olefins take on a spider-type structure. For example if desired the unsaturated trimer of decene-1 may be illustrated as

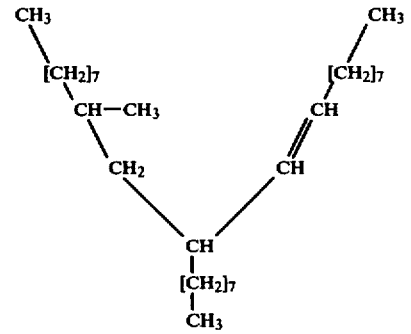

while the saturated (hydrogenated)trimer of decene-1 may be illustrated as

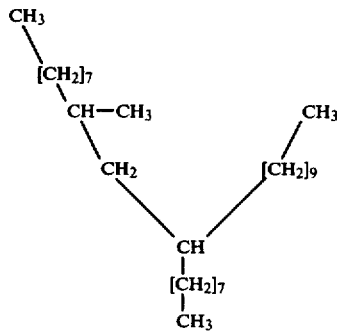

Thus correspondingly the unsaturated oligomer trimers of the specific n-alpha-olefins ($C_6$ to $C_{40}$) employed to derive the olefin oligomers used in this invention may be illustrated as

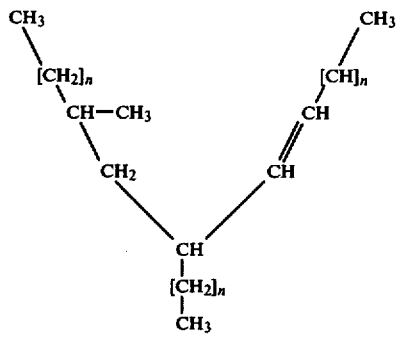

wherein n has a value of 3 to 37, while the corresponding saturated trimers may be illustrated as

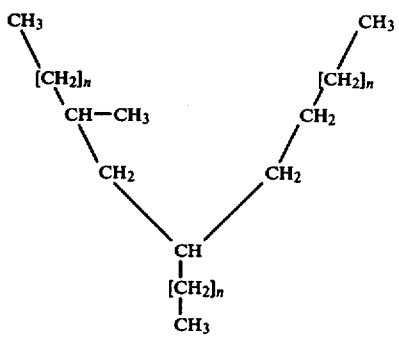

wherein n has a value of 3 to 37.

Illustrated of the more preferred olefin oligomers that can be employed in this invention are such commercial oils as the olefin oligomer "Synfluids" of Gulf Oil Chemicals, CO., the "SHC" olefin oligomers of Mobil Oil Company and the "MOX-ane" olefin oligomers of Millmaster Chemical Co., Division of Millmaster-Onyx Corporation, and the like. It is believed that such commercial Synfluid, SHC and MOX-ane oligomers are derived from n-decene-1 and that they are essentially saturated (hydrogenated) oligomers.

The silicone-hydrocarbon compositions of matter of this invention can be prepared in any conventional manner. Generally the two liquids need only be mixed together in the proportions desired while stirring at room temperature or slightly elevated temperatures. The proportions of silicone oil to olefin oligomer by volume in the compositions of matter of this invention can range from about 50 to about 95 percent by volume of the alkoxysiloxane oil to about 50 to about 5 percent by volume of olefin oligomer or from about 55 to about 95 percent (preferably about 70 to 95 percent) by volume of the dimethylsiloxane oil to about 45 to about 5 percent (preferably about 30 to 5 percent) by volume of olefin oligomer with the proviso that said proportions of the silicone oil and olefin oligomer are selected such that the two oils remain miscible with each other at about room temperature for at least 72 hours. The term "miscible" is used herein to mean that there is no development of either separation or precipitation observed in the composition containing only the silicone oil and olefin oligomer during the prescribed storage period. Preferably the compositions of matter of this invention are those in which the silicone oil and olefin oligomer remain miscible with each other at about 0° F. and more preferably at about −40° F. for at least 72 hours.

Of course, it is to be understood that not every possible olefin oligomer employable herein may be miscible for at least 72 hours at every temperature with every silicone oil employable herein. Likewise, it is to be understood that not every possible proportionate range by volume employable herein for every silicone oil and olefin oligomer component of this invention may give the same degree of results. However, experience has shown that compositions which are miscible for at least 72 hours will normally remain miscible over the service life of said compositions. It is further obvious that the determination of which particular olefin oligomer is best suitable for use in the instant invention can be readily determined by routine experimentation as taught herein.

As evidenced by their compatibility the silicone-hydrocarbon compositions of matter of this invention have good viscosity-temperature, viscosity-volatility and thermal stability characteristics as well as good fire resistance, low pour points and high flash points. They may be used as lubricants, hydraulic fluids, heat transfer fluids, transformer oils, transmission fluids, shock absorber fluids, damping fluids, textile lubricants, gear oils, mold release compounds, greases and the like. Preferably, the silicone-hydrocarbon compositions of matter of this invention may be employed as hydraulic fluids.

Accordingly, another aspect of this invention is a process for effecting movement of a movable member within enclosing chamber consisting of transmitting pressure to the movable member through a liquid medium comprising a silicone-hydrocarbon composition of matter of this invention as defined above.

Of course, it is to be understood that the specific type of hydraulic system is not critical and need not be described herein. Such systems are conventional and well known and the purpose of the present invention is not to define any particular novel mechanical system but to describe novel compositions of matter that are useful as lubricants and hydraulic fluids.

It is to be further understood that the silicone-hydrocarbon compositions of matter of this invention, if desired, can contain other conventional additives in the conventional used quantities commonly employed in hydraulic fluids, and the like, such as antioxidants, rust and corrosion inhibitors, anti-wear agents, dispersants, and the like.

The properties of typical olefin oligomers that can be employed in this invention are reported in the following Table I.

TABLE I

| Olefin Oligomer | Viscosity, cSt.(1) 210° F. | 100° F. | 0° F. | −40° F. | Viscosity(2) Index | Pour(3) Pt., °F. | Flash Pt., °F. | Evaporation Loss(5) 6.5 hrs. at 400° F., wt. % | Sp.Gr.(6) 60/60° C. | Br.(8) No. |
|---|---|---|---|---|---|---|---|---|---|---|
| /A/ Synfluid, 2 cSt. | 1.65 | 5.06 | 4511 | 221 | — | −65 | 300 | — | 0.7950 | 0.8 |
| /A/ Synfluid, 4 cSt. | 3.97 | 18.43 | 339 | 2514 | 124 | <−65 | 430 | 6.3 | 0.8171 | 0.1 |
| /A/ Synfluid, 6 cSt. | 5.82 | 32.03 | 806 | 7082 | 138 | <−65 | 470 | 5.5 | 0.8247 | 0.3 |
| /B/ Mobil SHC, 6 cSt. | 5.85 | 32.83 | 833 | 7830 | 134 | <−65 | 435 | 6.8 | 0.8271 | — |
| /C/ MOX-ane No. 1 | 1.75 | 5.48 | — | — | — | — | — | — | — | 0.13 |
| /C/ MOX-ane No. 4 | 3.95 | 18.16 | — | 2332 | 140 | −70 | 445 | 12.1 | — | 0.2 |
| /C/ MOX-ane No. 6 | 6.0 | 33.0 | 749 | 6793 | 140 | −70 | 445 | 1.0(7) | — | 0.75 |
| /C/ MOX-ane No. 6A | 5.79 | 33.9 | — | — | 124 | −70 | 455 | 1.42(7) | — | 0.89 |
| /C/ MOX-ane No. 14C | 14.64 | 114.6 | 7441 | — | 141 | −30 | 500 | — | — | 3.5 |
| /C/ MOX-ane No. 17C | 17.0 | 145 | 7600 | — | 137 | −35 | 485 | 0.91(7) | — | 1.0 |

/A/ Gulf Oil Chemicals Co.
/B/ Mobil Oil Co.
/C/ Millmaster Chemical Co., Div. of Millmaster-Onyx Corp.
(1)ASTM Test Method D-445
(2)ASTM Test Method D-2270
(3)ASTM Test Method D-97
(4)ASTM Test Method D-92
(5)ASTM Test Method D-972
(6)ASTM Test Method D-1298
(7)22 hours at 300° F.
(8)Given as Iodine Numbers for the MOX-ane oligomers.

The following Examples illustrate the present invention and are not to be regarded as limitative. As employed herein the following abreviations are used;

| Abreviation | Meaning |
|---|---|
| ASTM | American Society for Testing and Materials |
| Br. No. | Bromine Number |
| C° | degree centigrade |
| cSt | centistokes |
| °F. | degree Fahrenheit |
| hrs. | hours |
| IM | Immiscible |
| M | Miscible |
| Pt | point |
| RT | room temperature |
| Sp. Gr. | specific gravity |
| wt. | weight |
| % | percent |

In the average formula of the alkoxysiloxane compound given in the following Examples, "$C_{13}H_{27}$" represents a mixture of isomeric tridecyl groups derived by the removal of the hydroxyl groups in the tridecanol mixture of alcohols used as the starting material in the production of said alkoxysiloxanes. This starting material is a mixture of alcohols produced by the conventional oxo and reduction processes. The mixture of alcohols consists of about 5% by weight of $C_{11}$ alcohols, 20 percent by weight of $C_{12}$ alcohols, 64% by weight of $C_{13}$ alcohols and 10% by weight of $C_{14}$ alcohols. The alcohol mixture has a boiling point of 257.6 degrees C. at atmospheric pressure and a pour point of −40° C.

EXAMPLES 1-7

A series of silicone-hydrocarbon compositions was prepared by blending various siloxane oils with Gulf "Synfluid, 2 centistokes" as the olefin oligomer. The volume ratios of said compositions were varied as was the viscosity of the siloxane oil. Each composition was a 14 milliliter mixture and was tested for miscibility by being stored for at least 72 hours at room temperature (RT), zero degrees Farhenheit (0° F.) and minus forty degrees Farhenheit (−40° F.) after which they were observed for the development of separation and precipitation. If neither of these phenomena was observed the olefin oligomer was considered to be miscible (M) in the silicone oil. If either of these phenomena was observed, the olefin oligomer was considered to be immiscible (IM) in the silicone oil. The results of said tests as well as the particular siloxane oil employed in each composition and the siloxane oil to olefin oligomer percent volume ratio of each composition are reported in the following TABLE II.

TABLE II

| Ex. No. | Silicone Oil | Olefin Oligomer | % Volume Ratio Silicone (95)/Oligomer (5) RT | 0° F. | −40° F. | % Volume Ratio Silicone (90)/Oligomer (10) RT | 0° F. | −40° F. | % Volume Ratio Silicone (70)/Oligomer (30) RT | 0° F. | −40° F. | % Volume Ratio Silicone (50)/Oligoher (50) RT | 0° F. | −40° F. |
|---|---|---|---|---|---|---|---|---|---|---|---|---|---|---|
| 1 | Silioxane**, 1cSt | Synfluid, 2cSt* | M | M | M | M | M | M | M | M | M | M | M | M |
| 2 | Siloxane**, 200cSt. | Synfluid, 2cSt* | M | M | M | M | M | M | M | M | M | M | M | IM |
| 3 | Siloxane**, 500cst. | Synfluid, 2cSt* | M | M | M | M | M | M | M | M | M | M | IM | — |
| 4 | Siloxane**, 1000 cSt | Synfluid, 2cSt* | M | M | M | M | M | M | M | M | M | M | IM | — |
| 5 | Siloxane**, 10000 cSt | Synfluid, 2cSt* | M | M | M | M | M | M | M | M | M# | M | IM | — |
| 6 | Siloxane**, 100000 cSt. | Synfluid, 2cSt.* | M | M | M | M | M | M | M | M | M# | M | M# | M# |
| 7 | Alkoxy- | Synfluid, 2cSt* | M | M | M | M | M | M | M | M | M | M | M | M |

TABLE II-continued

| Ex. No. | Silicone Oil | Olefin Oligomer | % Volume Ratio Silicone (95)/ Oligomer (5) | | | % Volume Ratio Silicone (90)/ Oligomer (10) | | | % Volume Ratio Silicone (70)/ Oligomer (30) | | | % Volume Ratio Silicone (50)/ Oligoher (50) | | |
|---|---|---|---|---|---|---|---|---|---|---|---|---|---|---|
| | | | RT | 0° F. | −40° F. | RT | 0° F. | −40° F. | RT | 0° F. | −40° F. | RT | 0° F. | −40° F. |
| | siloxane*** | | | | | | | | | | | | | |

*Same as defined in TABLE I above
**A trimethyl end-blocked dimethylsiloxane having the average formula $Me_3SiO(Me_2SiO)_xSiMe_3$
***An alkoxy end-blocked dimethylsiloxane having the average formula $C_{13}H_{27}O[(CH_3)_2SiO]_nC_{13}H_{27}$ which had a pH of 7.0 in a 50%-50% water-isopropanol mixture at 10% concentration, a viscosity at 100° F. of 17.5 cSt. and 6.08 cSt. at 210° F., no detectable unreacted hydrolyzate cyclics and only 0.2% unreacted alcohol.
#Cloudiness was observed.

EXAMPLES 8-17

A series of silicone-hydrocarbon compositions was prepared by blending various siloxane oils with Gulf "Synfluid, 4 centistokes" as the olefin oligomer. The volume ratios of said compositions were varied as was the viscosity of the siloxane oil. Each composition was a 14 milliliter mixture and was tested for miscibility by being stored for at least 72 hours at room temperature (RT), zero degrees Farhenheit (0° F.) and minus forty degrees Farhenheit (−40° F.) after which they were observed for the development of separation and precipitation. If neither of these phenomena was observed the olefin oligomer was considered to be miscible (M) in the silicone oil. If either of these phenomena was observed, the olefin oligomer was considered to be immiscible (IM) in the silicone oil. The results of said tests as well as the particular siloxane oil employed in each composition and the siloxane oil to olefin oligomer percent volume ratio of each composition are reported in the following TABLE III.

EXAMPLES 18-25

A series of silicone-hydrocarbon compositions was prepared by blending various siloxane oils with Gulf "Synfluid, 6 centistokes" as the olefin oligomer. The volume ratios of said compositions were varied as was the viscosity of the siloxane oil. Each composition was a 14 milliliter mixture and was tested for miscibility by being stored for at least 72 hours at room temperature (RT), zero degrees Farhenheit (0° F.) and minus forty degrees Farhenheit (−40° F.) after which they were observed for the development of separation and precipitation. If neither of these phenomena was observed the olefin oligomer was considered to be miscible (M) in the silicone oil. If either of these phenomena was observed, the olefin oligomer was considered to be immiscible (IM) in the silicone oil. The results of said tests as well as the particular siloxane oil employed in each composition and the siloxane oil to olefin oligomer percent volume ratio of each composition are reported in the following TABLE IV.

TABLE III

| Ex. No. | Silicone Oil | Olefin Oligomer | % Volume Ratio Silicone (95)/ Oligomer (5) | | | % Volume Ratio Silicone (90)/ Oligomer (10) | | | % Volume Ratio Silicone (70)/ Oligomer (30) | | | % Volume Ratio Silicone (50)/ Oligomer (50) | | |
|---|---|---|---|---|---|---|---|---|---|---|---|---|---|---|
| | | | RT | 0° F. | −40° F. | RT | 0° F. | −40° F. | RT | 0° F. | −40° F. | RT | 0° F. | −40° F. |
| 8 | Siloxane**, 1cSt | Synfluid, 4cSt. | M | IM | IM | M | IM | IM | M | IM | IM | M | IM | IM |
| 9 | Siloxane**, 10 cSt | Synfluid, 4cSt* | M | M | M | M | M | IM | M | M | IM | M | M | IM |
| 10 | Siloxane**, 50 cSt | Synfluid, 4cSt* | M | M | M | M | M | IM | IM | — | — | IM | — | — |
| 11 | Siloxane**, 100 cSt | Synfluid, 4cSt* | M | M | M# | M | IM | — | IM | — | — | IM | — | — |
| 12 | Siloxane**, 200 cst | Synfluid, 4cSt* | M | M# | M# | M | IM | — | IM | — | — | IM | — | — |
| 13 | Siloxane 500 cSt | Synfluid, 4cSt* | M | M# | M# | M | IM | — | IM | — | — | — | — | — |
| 14 | Siloxane**, 1000 cSt | Synfluid, 4cSt* | M | M# | M#M | IM | — | IM | — | — | — | — | — | |
| 15 | Siloxane**, 1000cSt | Synfluid, 4cSt* | M | M+ | M | IM | — | — | — | — | — | — | — | — |
| 16 | Siloxane**, 100000 cSt. | Synfluid, 4cSt* | M | M | M# | M | M# | M# | IM | — | — | IM | — | — |
| 17. | Alkoxy-siloxane*** | Synfluid, 4cSt* | M | M# | M# | M | M | M | M | M | M | M | M | M |

*Same as defined in TABLE I above.
**Same as defined in TABLE II above.
***Same as defined in TABLE III above.
#Cloudiness was observed
+Haze was observed

TABLE IV

| Ex. No. | Silicone Oil | Olefin Oligomer | % Volume Ratio Silicone (95)/ Oligomer (5) | | | % Volume Ratio Silicone (90)/ Oligomer (10) | | | % Volume Ratio Silicone (70)/ Oligomer (30) | | | % Volume Ratio Silicone (50)/ Oligomer (50) | | |
|---|---|---|---|---|---|---|---|---|---|---|---|---|---|---|
| | | | RT | 0° F. | 40° F. | RT | 0° F. | 40° F. | Rt | 0° F. | 40° F. | RT | 0° F. | 40° F. |
| 18 | Siloxane**, 1 cSt | Synfluid 6cSt.* | M | IM | IM | M | IM | IM | M | IM | IM | M | IM | IM |
| 19 | Siloxane**, 10 cSt. | Synfluid 6cSt* | M | M | IM | M | IM | — | M | IM | — | M | IM | — |

TABLE IV-continued

| Ex. No. | Silicone Oil | Olefin Oligomer | % Volume Ratio Silicone (95)/ Oligomer (5) | | | % Volume Ratio Silicone (90)/ Oligomer (10) | | | % Volume Ratio Silicone (70)/ Oligomer (30) | | | % Volume Ratio Silicone (50)/ Oligomer (50) | | |
|---|---|---|---|---|---|---|---|---|---|---|---|---|---|---|
| | | | RT | 0° F. | 40° F. | RT | 0° F. | 40° F. | Rt | 0° F. | 40° F. | RT | 0° F. | 40° F. |
| 20 | Siloxane**, 50 cSt | Synfluid 6cSt* | M | — | — | IM | — | — | IM | — | — | IM | — | — |
| 21 | Siloxane**, 100 cSt | Synfluid 6cSt* | M | IM | — | IM | — | — | — | — | — | — | — | — |
| 22 | Siloxane**, 200 cSt | Synfluid 6cSt* | M | IM | — | IM | — | — | — | — | — | — | — | — |
| 23 | Siloxane 500 cSt | Synfluid 6cSt* | IM | — | — | IM | — | — | — | — | — | — | — | — |
| 24 | Siloxane**, 1000 cSt | Synfluid 6cSt* | IM | — | — | IM | — | — | — | — | — | — | — | — |
| 25 | Alkoxy-siloxane*** | Synfluid 6cSt.* | M | M | M | M | M | M | M | M | M | M | M | M |

*Same as defined in TABLE I above.
**Same as defined in TABLE II above.
***Same as defined in TABLE II above.

EXAMPLES 26–28

A series of silicone-hydrocarbon compositions was prepared by blending various siloxane oils with Gulf "Synfluid, 2 centistokes" as the olefin oligomer. The volume ratios of said compositions were varied as was the viscosity of the siloxane oil. Each composition was a 25 milliliter mixture and was tested for miscibility by being stored for at least 72 hours at room temperature (RT), zero degrees Farhenheit (0° F.) and minus forty degrees Farhenheit (−40° F.) after which they were observed for the development of separation and precipitation. If neither of these phenomena was observed the olefin oligomer was considered to be miscible (M) in the silicone oil. If either of these phenomena was observed, the olefin oligomer was considered to be immiscible (IM) in the silicone oil. The results of said tests as well as the particular siloxane oil employed in each composition and the siloxane oil to olefin oligomer percent volume ratio of each composition are reported in the following TABLE V.

TABLE V

| Ex. No. | Silicone Oil | Olefin Oligomer | % Volume Ratio Silicone (95)/ Oligomer (5) | | | % Volume Ratio Silicone (90)/ Oligomer (10) | | | % Volume Ratio Silicone (70)/ Oligomer (30) | | |
|---|---|---|---|---|---|---|---|---|---|---|---|
| | | | RT | 0° F. | −50° F. | RT | 0° F. | −50° F. | RT | 0° F. | −50° F. |
| 26. | Siloxane**, 10 cSt | Synfluid, 2cSt* | M | M | M | M | M | M | M | M | M+ |
| 27. | Siloxane**, 50 cSt | Synfluid, 2cSt* | M | M | M | M | M | M+ | M | M | M+ |
| 28. | Siloxane** 100 cSt | Synfluid, 2cSt* | M | M | M | M | M | M+ | M | M | M+ |

*Same as defined in TABLE I above.
**Same as defined in TABLE II above
+ Haze was observed

EXAMPLE 29

A 15 milliter composition consisting of a blend of 70 percent by volume of a trimethyl end-blocked dimethylsiloxane oil having a 100 centistoke viscosity at 25° C. and 30 percent by volume of "MOX-ane No. 1" (same as defined in TABLE I above) as the olefin oligomer was prepared.

Miscibility tests were run on said composition according to the testing procedure described in Example 1 and the results were as follows.

| Room Temperature 72 Hours | 0° F. 72 Hours | −40° F. 72 Hours |
|---|---|---|
| Miscible | Miscible | Miscible |

EXAMPLES 30–42

A series of silicone-hydrocarbon compositions was prepared by blending various siloxane oils with various olefin oligomers and the compositions were tested for lubricity according to the proposed Falex Machine Method of ASTM D-2-Section V, Tech. K. Said test is a measure of the lubricity of a material in terms of its load carrying ability. The maximum load carrying ability of a test sample is indicated in pounds and is that point during the test at which the wear on a No. 8 stainless steel test pin is occurring at such a fast rate that the loading ratchet of the machine cannot keep up and the load decreases consequently. By way of comparison, tests were also conducted on the use of siloxane oils and olefin oligomers per se. Each test was conducted in the same manner according to the procedure of ASTM D-2-Section V, Tech. K. save for the fact that the machine was not calibrated, that a load gauge in the range of 0 to 800 pounds was used, that the five minute break-in period was 250 pounds, and that readings were taken at every 50 pound interval were possible. The results of said tests are reported in the following TABLE VI.

TABLE VI

| Ex. No. | Formulation | Maximum Load, Pounds+ |
|---|---|---|
| 30 | 95% by volume Siloxane, 100 cSt*<br>5% by volume Synfluid, 4cSt** | 50 |
| 31 | 70% by volume Siloxane, 100 cSt*<br>30% by volume Synfluid, 2cSt** | 150 |
| 32 | 70% by volume Siloxane, 100 cSt*<br>30% by volume MOX-ane No. 1** | 100 |

TABLE VI-continued

| Ex. No. | Formulation | Maximum Load, Pounds+ |
|---|---|---|
| 33 | 50% by volume Alkoxysiloxane*<br>50% by volume Synfluid, 6cSt** | 400 |
| 34 | 95.7% by weight Siloxane, 10000 cSt*<br>4.3% by weight Synfluid, 4cSt** | 120 |
| 35 | 95.2% by weight Siloxane, 10000 cSt*<br>4.3% by weight Synfluid, 4cSt**<br>0.5% by weight Ortholeum 162*** | 100++ |
| 36 | 100% Siloxane 100 cSt* | 50 |
| 37 | 100% Siloxane, 10000 cSt* | 125-150 |
| 38 | 100% Alkoxysiloxane* | 250 |
| 39 | 100% Synfluid, 2cSt** | 200 |
| 40 | 100% Synfluid, 4cSt** | 250++ |
| 41 | 100% Synfluid, 6cSt** | 250 |
| 42 | 99.5% by weight Siloxane, 10000 cSt*<br>0.5% by weight Ortholeum 162*** | 100 |

+That point during the test at which the wear on a No. 8 stainless steel test pin occurred faster than the loading ratchet could increase the load.
++After reaching the maximum load of 100 pounds and decreasing to zero, the load began to increase and gradually completed the 800 pound load gauge scale used. Two more test runs on the same formulation gave maximum loads of 140 and 150 pounds.
+++The No. 8 stainless steel test pin broke.
*Same as defined in TABLE II above.
**Same as defined in Table I above.
***An anti-wear agent consisting of a mixture of alkyl acid orthophosphates. (E.I. Dupont de Nemours and Company, Inc.)

Miscibility tests were also conducted on about a 65 gram mixture of the composition of Example 35 (hereinafter referred to as Blend A), about a 90 gram mixture of the composition of Example 42 (hereinafter referred to as Blend B), and about 125 grams of a composition consisting of 73.24% by weight of a trimethyl end-blocked dimethylsiloxane oil having a viscosity of 10,000 centistokes at 25° C., 13.38% by weight of "Synfluid 6 cSt" (same as defined in TABLE I above) and 13.38% by weight of Hercolube 402, a polyester anti-wear agent of Hercules Chemical Company, (hereinafter referred to as Blend C). Blend A was found to be miscible and hazy immediately after having been made at room temperature and to be miscible and cloudy upon storage for 72 hours at −40° F. Blend B was found to be immiscible immediately after having been made at room temperature and to be immiscible (separation) upon storage for 72 hours at −40° F. Blend C was found to be miscible immediately after having been made at room temperature and was not tested at −40° F.

EXAMPLES 42–45

A series of silicone-hydrocarbon compositions was prepared by blending trimethyl end-blocked dimethylsiloxane, 100 centistokes, with various olefin oligomers. The volume ratios of said compositions were varied and each composition (25 milliliter mixtures) was tested for miscibility at room temperature (RT) and at minus forty degrees Farhenheit (−40° F.) by observing the compositions for the development of separation and precipitation. If neither of these phenomena was observed the olefin oligomer was considered to be miscible (M) in the silicone oil. If either of these phenomena was observed the olefin oligomer was considered to be immiscible (IM) in the silicone oil. The room temperature observations were completed immediately after the blends were made, while the −40° F. observations were made after the compositions had been stored at −40° F. for 142 hours. The results of said tests as well as the particular olefin oligomer employed in each composition and the siloxane oil to olefin oligomer percent volume ratio of each composition are reported in the following TABLE VII.

TABLE VII

| Ex. No. | Silicone Oil | Olefin Oligomer | % Volume Ratio Silicone (95)/ Oligomer (5) RT | % Volume Ratio Silicone (95)/ Oligomer (5) −40° F. | % Volume Ratio Silicone (70)/ Oligomer (30) RT | % Volume Ratio Silicone (70)/ Oligomer (30) −40° F. |
|---|---|---|---|---|---|---|
| 43 | Siloxane*, 100 cSt | $C_6$, Pentamer, 4.17 cSt+ | M# | M | M | IM |
| 44 | Siloxane*, 100 cSt | $C_8$, Tetramer 4.18 cSt++ | M | M | M | IM |
| 45 | Siloxane*, 100 cSt | $C_{12}$, Trimer 5.22 cSt+++ | M# | IM | M | IM |

*Same as defined in TABLE II above.
+A pentamer derived from n-hexene-1.
++A trimer derived from n-octene-1.
+++A trimer derived from n-dodecene-1.
#Cloudiness was observed.

Various modifications and variations of this invention will be obvious to a worker skilled in the art and it is to be understood that such modifications and variations are to be included within the purview of this application and the spirit and scope of the appended claims.

What is claimed is:

1. A composition of matter consisting essentially of (A) about 50 percent by volume of an alkoxy end-blocked dimethylsiloxane having the average formula $$C_{13}H_{27}O[(CH_3)_2SiO]_nC_{13}H_{27}$$

which has a pH of 7.0 in a 50%-50% water-isopropanol mixture at 10% concentration, a viscosity at 100° F. of 17.5 centistokes and 6.08 centistokes at 210° F., no detectable unreacted hydrolyzate cyclics and only 0.2% unreacted alcohol, and (B) about 50 percent by volume of a saturated olefin oligomer derived from n-decene-1 having a viscosity at 210° F. of about 5.82, a flash point of about 470 and a specific gravity of about 0.8247.

* * * * *